United States Patent [19]

Avener

[11] Patent Number: 4,531,800

[45] Date of Patent: Jul. 30, 1985

[54] PROTECTOR DEVICE FOR ELECTRICAL OUTLETS

[76] Inventor: Marshall S. Avener, 113 E. Linn St., Bellefonte, Pa. 16823

[21] Appl. No.: 547,073

[22] Filed: Oct. 31, 1983

[51] Int. Cl.[3] ..... H01R 13/625

[52] U.S. Cl. ..... 339/75 P; 339/39; 339/90 R

[58] Field of Search ..... 339/36, 37, 39, 75 P, 339/90 R, 82

[56] References Cited

U.S. PATENT DOCUMENTS

| | | | |
|---|---|---|---|
| 2,716,225 | 8/1955 | McCubbin | 339/75 P |
| 3,030,601 | 4/1962 | Krebs | 339/75 P |
| 3,363,216 | 1/1968 | Benedetto | 339/75 P |
| 3,601,757 | 8/1971 | Gober | 339/75 P |
| 4,076,360 | 2/1978 | Singh | 339/36 |
| 4,168,105 | 9/1979 | Herrmann, Jr. | 339/90 R |
| 4,359,256 | 11/1982 | Gallusser et al. | 339/90 R |
| 4,457,571 | 7/1984 | Lavine et al. | 339/75 P |

*Primary Examiner*—John McQuade

*Attorney, Agent, or Firm*—Thomas E. Sterling

[57] ABSTRACT

This invention consists of a device attachable to an electrical outlet and wall socket which will prevent babies and small children from pulling out the plug, inserting their fingers or other objects into the socket and onto the plug where they might receive a damaging electrical shock. In general the invention consists of an attachable receptacle plate with raised collars positioned upon the electrical wall outlet. A flexible split cap is positioned about the electrical cord and plug. The caps engage the collars in a locking relationship such that they can not be disengaged by a baby or small child. The caps attached to the collars by means of protruding stubs which are guided into tracks in the collars. In addition, flexible locking tab on the caps is forced inward when the cap is turned and pops outwardly in locking position through a hole in the collar. The cap can only be disengaged from the collar by pushing the locking tab inward and turning the cap. This can not be accomplished by a baby or infant, hence a small child is protected from shocking itself.

6 Claims, 5 Drawing Figures

PROTECTOR DEVICE FOR ELECTRICAL OUTLETS

PRIOR ART STATEMENT:

The inventor knows of no uncited prior art anticipating this invention. The inventor is not withholding known prior art which he considers to anticipate this invention.

This invention relates to safety locking devices, and in particular to a safety locking device attachable to an electrical wall outlet.

Babies and small children often play with electrical outlets, plugs and cords found in the home. In this play, the child will often stick his fingers, tongue or other parts of the body in or about the electrical outlet, the plug or other conducting surfaces exposing himself to the severe electrical shock of line voltage. Such a shock can injure and possibly kill a small child, particularly if its body is grounded by wet clothing, diapers or the like. It is the purpose of this invention to provide a protective covering over the electrical outlet, plug and cord which will prevent a small child from pulling the plug, or otherwise contacting line voltage conductors on the electrical outlet or plug combination.

It is therefore an object of this invention to provide an attachable covering for a standard electrical outlet, plug or cord to prevent a small child from receiving an electrical shock.

It is another object of this invention to provide a flexible and elastic split cap insertable around an electrical cord and plug and engagable by a receptacle plate adaptable to a standard electrical outlet.

It is yet another object of this invention to provide a flexible splite cap having protruding stubs and locking tab thereon which are engagable on collars extending from an electrical receptacle plate in a locking manner.

It is yet another object of this invention to provide an easy and convenient device for locking electrical plugs to receptacle outlets.

These and other objects of the invention may be seen by referring to the below Specification and Claims taken in conjunction with the accompanying drawings in which:

Figure 2:
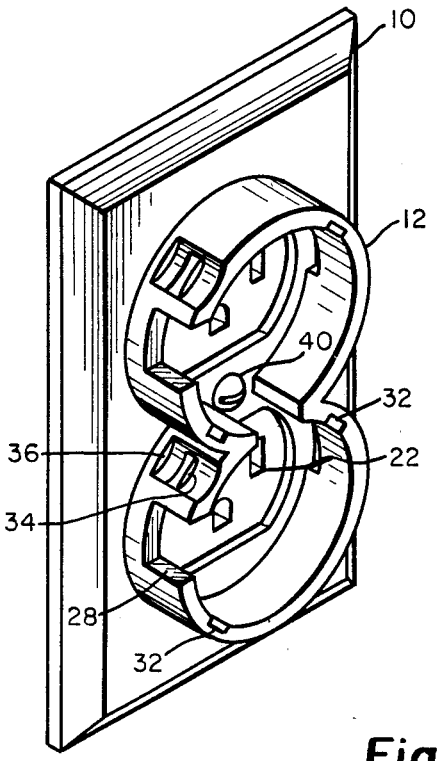
FIG. 2, is a third-dimensional view showing the invention in a disengaged position, consisting of a receptacle plate attached to a standard electrical wall outlet and a flexible split ring cap in an open position.
Figure 1:
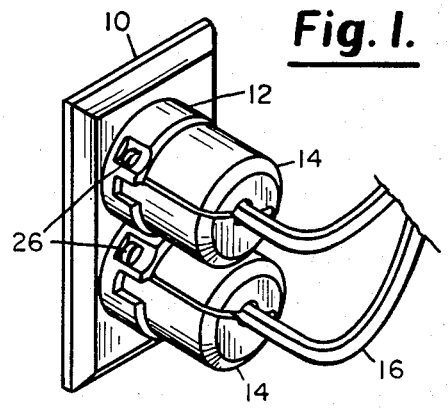
FIG. 1, is a third-dimensional view showing one modification of the present invention attached in a locking relationship to a standard wall outlet and plugs.
Figure 3:
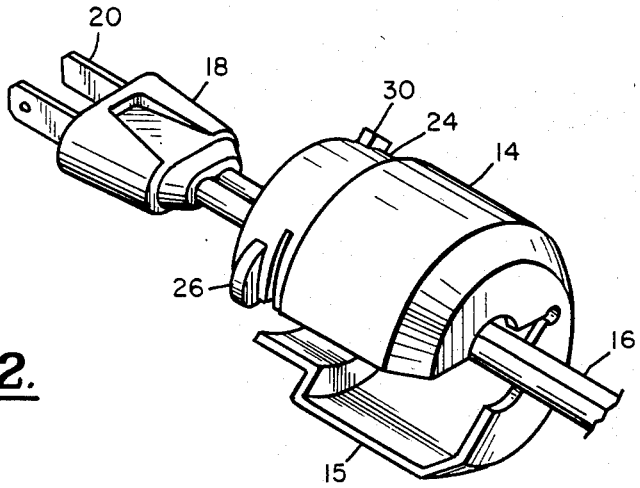
FIG. 3, is a side view of the invention in the engaged position with a single split ring cap inserted in the collars.

Referring to the drawings and in particular to FIGS. 1 and 2, 10 is a receptacle plate of this invention having raised collars 12 extending therefrom into which is inserted a cylindrical shaped flexible split cap 14 which encloses an electrical cord 16 and an electrical plug 18. Plug 18 has extending therefrom prongs 20 which may be inserted in electrical outlet holes 22 of an electrical outlet within the raised collars 12. Receptacle plate 10 is attached to the standard wall outlet by screw 40 which extends into the wall outlet. Receptacle plate 10 may be attached to any standard wall outlet by a screw 40 or by other means.

The flexible split cap 14 is comprised of a mating portion 24 of lesser diameter adapted to fit within raised collars 12 on the receptacle plate 10. Split cap 14 is made of flexible and elastic non-conductive material which may be easily opened, closed or pressed, and which will immediately resume its original shape. A plastic material has proven very satisfactory. A flexible elastic locking tab 26 extends radially outward from mating portion 24 and is adapted to fit into tab slot 28 extending through the edge portion of raised collars 12. Two locking stubs 30 extend radially outward from mating portion 24 and are adapted to be engaged by locking stub slots 32 positioned on the inner surface of raised collars 12. Locking stub slots 32 extend laterally within raised collars 12 to the bottom portion thereof and then at right angles along the bottom edge of raised collars 12. Locking stubs 30 may be inserted within locking stub slots 32, pressed to the bottom portion of raised collars 12 and turned clockwise to secure split cap 14 to raised collars 12. Flexible split cap 14 has a lateral cut 15 therethrough permitting it to be forced open to enclose plug 18 and cord 16.

Figure 4:
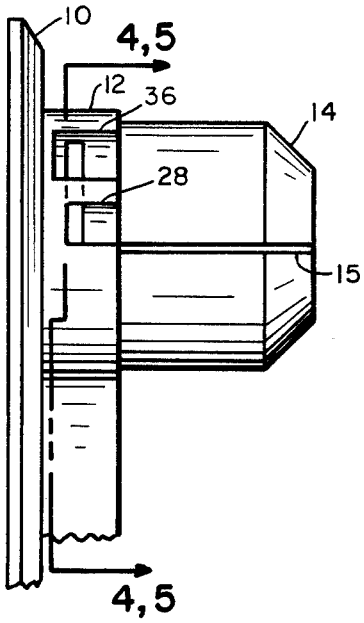
FIG. 4, is a view taken along line 4—4 of FIG. 3 showing the split cap in an unlocked position.
Figure 4:
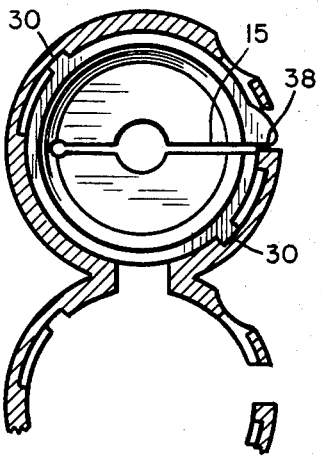
Figure 5:
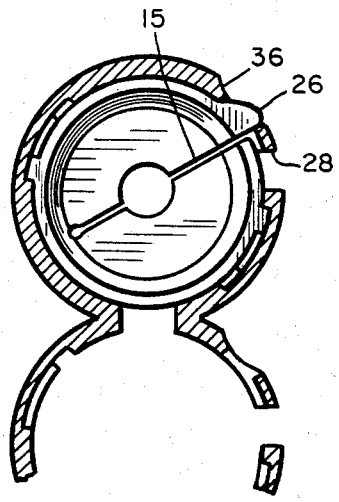
FIG. 5, is a view taken along line 5–5 of FIG. 3 showing the split cap in a locked position.

A locking slot 34 extends circumferentially from the bottom portion of tab slot 28 allowing locking tab 26 to be turned therein in a clockwise direction. A circular shaped tab indentation 36 is cut from the outer portion of raised collars 12 so as to meet locking slot 34. When locking tab 26 is inserted within tab slot 28 and turned clockwise, locking tab 26 is first depressed and then pops outwardly within locking slot 34 and tab indentation 36. The flat surface 38 of locking tab 26 holds locking tab 26 in position against raised collar 12 until locking tab 26 is pressed inwardly by finger pressure. Split cap 14 is then turned counter-clockwise and withdrawn from raised collars 12. FIGS. 4 and 5 show the split cap 14 in the unlocked (FIG. 4) and locked (FIG. 5) position.

Split cap 14 completely encloses plug 18 when prongs 20 are inserted in electrical outlet holes 22. When split cap 14 is in its locked position, plug 18 may not be pulled from receptacle plate 10 and may not be releasaed except by pressure on locking tab 26. A baby or small child is not able to press tab 26 or unlock the invention, hence the child is unable to contact electrical conductors transmitting dangerous electrical current. It should be noted that split cap 14 may be locked within raised collars 12 without an electrical cord 16 and plug 18, thus protecting outlet holes 22 from contact with a child's body.

In operation, split cap 14 is pressed open and inserted over electrical cord 16 and plug 18. Prongs 20 are then inserted in electrical outlet holes 22, thus supplying electrical power to cord 16. Split cap 14 is then pressed within raised collars 12 with locking tab 26 inserted in tab slot 28 and locking stubs 30 inserted within locking stub slots 32. Split cap 14 is then turned clockwise forcing locking stubs 30 in stub slots 32, thus locking split cap 14 within raised collars 12 so that it may not be pulled outwardly.

When split cap 14 is turned clockwise, flexible locking tab 26 is depressed, and turned into locking slot 34. Tab 26 snaps outwardly in tab indentation 36. Flat surface 38 bears against the edge of raised collars 12 so that the slit cap 14 may not be turned counter-clockwise until tab 26 is pressed. The split cap 14 is thus locked within raised collars 12 and the device is in its locked position and can not be rotated. In the locked position a small child or infant is unable to unlock the device and thus can not contact any of the electrical conduits therein. This child is thus prevented from receiving an electrical shock.

When it is desired to unlock the device, locking tab 26 is pressed inwardly and split cap 14 turned counterclockwise, allowing locking tab 26 to return to tab slot 28 and locking stubs 30 to slide within locking stub slots 32 to the unlocked position. Split cap 14 may then be pulled directly outward and plug 18 disengaged.

As may be seen, receptacle plate 10 with raised collars 12 may be screwed into any standard electrical outlet by utilizing screw 40. Likewise split cap 14 is of sufficient size to enclose any standard size electrical plug 18 and may be placed about any standard electrical cord 16. The invention is thus adaptable to any standard electrical outlet or plug-cord combination and may be installed or removed from such an electrical outlet. While installed and in the locked position, the electrical outlet is rendered safe from crawling babies or children, both when an electrical plug is engaged and when no plug is used. The device has thus made safe electrical outlets for exploring babies or small children.

It is within the contemplation of this invention that a receptacle plate 10 may have a number of raised collars 12 adapted to receive a number of split caps 14. Likewise, the invention may utilize one or more locking stubs 30 adapted to engage one or more locking stub slots 32. Likewise, it is within the contemplation of this invention that receptacle plate 10 may be secured to an electrical outlet by other means than a screw 40.

I claim:

1. An interchangeable protective device adapted for installation upon an electrical outlet, plug and cord connected thereto, comprising in combination:

a receptacle plate having an electrical outlet thereon;

a raised collar on said receptacle plate encircling said electrical outlet, said raised collar having:

a tab slot extending longitudinally inward through said raised collar;

a locking slot extending approximately perpendicular to said tab slot in a circumferential direction through the inner portion of said raised collar;

a tab indentation extending from said locking slot to the outer surface of said raised collar;

a split cap positioned about an electrical plug and cord, said split cap adapted for insertion within said raised collar;

a flexible locking tab adapted for inward motion extending from the outer surface of said split cap, adapted to engage said tab slot and said locking slot, and to protrude through said tab indentation, said locking tab adapted to being unlocked when pressed inwardly;

a flat surface positioned on said locking tab adapted to bear against said locking slot in a locking relationship.

2. The combination as claimed in claim 1, in which said raised collar has a locking stub slot longitudinally positioned on the inner surface thereof extending inwardly on said raised collar and extending circumferentially along the inner surface of said raised collar;

a locking stub extending outwardly from said split cap adapted to engage said locking stub slot.

3. The combination as claimed in claim 2, in which said split cap has an opening therethrough and a slit extending from said opening longitudinally through one side portion of said split cap, said slit adapted to spread elastically outward to receive an electrical cord and plug.

4. The combination as claimed in claim 3, in which said receptacle plate contains more than one electrical outlet.

5. The combination as claimed in claim 4, in which said split cap is made of a flexible elastic plastic material.

6. The combination as claimed in claim 5, in which said receptacle plate is removably attached to said electrical outlets by a removable screw.

* * * * *